US005913931A

United States Patent [19]

Gargrave et al.

[11] Patent Number: 5,913,931

[45] Date of Patent: Jun. 22, 1999

[54] EXTENDED LENGTH ROTARY BENDING AND FORMING DEVICES AND METHODS FOR MANUFACTURE THEREOF

[75] Inventors: Daniel J. Gargrave, Centerville; Steven W. Thompson, Dayton; David Michael Wilson, Huber Heights, all of Ohio

[73] Assignee: Ready Technology, Inc.

[21] Appl. No.: 08/963,954

[22] Filed: Nov. 4, 1997

[51] Int. Cl.[6] ..... B21D 5/01

[52] U.S. Cl. ..... 72/387; 72/319

[58] Field of Search ..... 72/387, 312, 313, 72/319, 320, 388, 321

[56] References Cited

U.S. PATENT DOCUMENTS

| | | | |
|---|---|---|---|
| 4,002,049 | 1/1977 | Randolph, Sr. | 72/388 |
| 4,181,002 | 1/1980 | Eckhold et al. | 72/387 |
| 4,434,644 | 3/1984 | Gargrave et al. | 72/387 |
| 4,535,619 | 8/1985 | Gargrave et al. | 72/481 |
| 4,562,721 | 1/1986 | Bleye | 72/387 |
| 5,341,669 | 8/1994 | Katz | 72/387 |
| 5,361,620 | 11/1994 | Meadows | 72/387 |
| 5,404,742 | 4/1995 | Wilson et al. | 72/387 |

*Primary Examiner*—David Jones
*Attorney, Agent, or Firm*—Pendorf & Cutliff

[57] ABSTRACT

An extended length rotary bending and forming device and method for manufacture thereof, the combination of materials and process steps used in the manufacture resulting in the production of the desired durable long length heavy duty rotary bender.

21 Claims, 1 Drawing Sheet

EXTENDED LENGTH ROTARY BENDING AND FORMING DEVICES AND METHODS FOR MANUFACTURE THEREOF

BACKGROUND OF THE INVENTION

1. Field of the Invention

The present invention concerns a rotary bending and forming device, and more particularly, an extended length rotary bending and forming device and method for manufacture thereof.

2. Description of the Related Art

Rotary bending devices of the type with which the present invention is generally concerned are well known, for example, from U.S. Pat. No. 5,404,742 to Wilson entitled "Rotary hemming device"; U.S. Pat. No. 4,756,863 to Petershofer entitled "Method for hot-forming a laminated sheet of synthetic resin and a device for working this method"; U.S. Pat. No. 5,253,502 to Poletti entitled "Apparatus and method for bending and forming sheet material"; U.S. Pat. No. 5,462,424 to Kuroyone entitled "Metallic die device for press machine"; U.S. Pat. No. 5,474,437 to Kuroyone entitled "Metallic die device for press machine"; U.S. Pat. No. 4,092,840 to Eckold entitled "Device for flanging the edges of sheet sections"; U.S. Pat. No. 4,181,002 to Eckold entitled "Tools for bending sheet metal"; U.S. Pat. No. 4,434,644 to Gargrave entitled "Rotary bending and forming devices"; U.S. Pat. No. 4,520,646 to Pauzin entitled "Sheet-metal bending brake"; U.S. Pat. No. 4,535,619 to Gargrave entitled "Rotary bending, particularly for press brakes"; U.S. Pat. No. 5,341,669 to Katz entitled "Rotary bending tool with continuous lubrication"; U.S. Pat. No. 5,361,620 to Meadows entitled "Method and apparatus for hemming sheets of metal material"; and U.S. Pat. No. 5,640,873 to Costabile entitled "Punch and die assembly".

However, despite the variety of designs and improvements in the rotary bender art, the industry has not yet developed a long length rotary bender suitable for high production metal stamping dies, dies to form high strength or thick steel and forming long panels in automated machines.

A rotary bending and forming device essentially comprises an operating head and a holder, generally referred to as rocker and saddle, respectively. The rocker is a generally cylindrically formed rocker element having an approximately "V" shaped recess continuous in length with its outer peripheral surface, the angle between the two arms of the V-shaped recess being determined largely by the bend angle of the formed component to be bent, in most cases being on the order of magnitude of 90°.

The holder comprises a saddle and generally also a gib. The saddle comprises a saddle block with an approximately semicircular recess, preferably having a smooth precision surface. Such a precision bearing surface ideally provides a low coefficient of friction seat for the rocker element, in an arrangement which substantially increases the load accommodating and long production life capability of the saddle as well as the mating rocker.

Once the rocker element is seated, the gib is releasably connected to the saddle to have a limited portion thereof overlie and lightly bear against and contain the rocker element to its seat. The construction and arrangement of the gib provides for a balanced and stable mount of the rocker element, which insures the proper orientation of its groove throughout the course of its application in a bending or forming procedure.

The gib and/or the saddle may include means for applying lubricant to the outer peripheral surface portion of the rocker element. These lubricating devices afford an economical means for insuring a smooth and effective function of the rocker element and avoidance of unnecessary wear on the related parts.

The rotary bending head and its V-shaped recess cooperate with a correspondingly shaped bottom die, the bent component to be shaped being formed around the bottom die by the recess in the rotary bending head. In the process, the rotary bending head is first subjected to a translational movement by the descending saddle block in which it is pivotably mounted, a rotational movement being superposed on the translational movement during the actual shaping process. The bearing assembly of the rotary bending head in the saddle block is therefore of the utmost importance, since not only does it transmit the pressing pressure, but it must at the same time permit the rotary bending head to rotate as smoothly as possible.

Obviously, the bearing surfaces of the saddle block and the outer periphery of the rocker must be fitted to each other with close tolerances. Benders can only be made in lengths at which these close tolerances can be achieved in the manufacturing process. To date it has not been possible to form hardened saddles and rockers with sufficient dimensional accuracy to have close tolerances at longer lengths.

That is, while benders for making long length bends are known, these benders will usually produce only a limited volume of bends before failure. One such long length bender is available from Ready Technology of Dayton, Ohio, and has the rocker and saddle made of a 4140/4150 prehardened brake die steel. Brake die steel is a good material; it work hardens over time, and for lower production volumes it is a good choice. Benders can be manufactured of this material in, e.g., 24, 36 or 48 inch lengths or longer. There is, however, a problem in that there is not a sufficient dissimilarity between the brake die steel of the rocker and the steel of the saddle as far as hardness. The bending devices are under high compressive load and can be subject to galling if any foreign matter gets between the rocker and saddle. A good separation in hardness between the two contacting members (rocker and saddle) is necessary in order to eliminate galling. Sometimes even the force that is required in the compressive load of the rockers and saddle when bending thick high strength steel is sufficient by itself to cause galling. Accordingly, this medium production type unit is not suitable for commercial high volume or high strength production requirements.

On the other hand, rotary benders for commercial high volume bending of higher strength or thicker steel are also known, and include those manufactured by Ready Technology. These benders have a full hardened steel rocker made from A2 or A6 steel hardened to Rc 60, and a rocker saddle (saddle block) made of through-hardened tool steel hardened to Rc 48–52. However, due to inability to produce the rocker and saddle without warp, it has only been possible to produce these hardened rotary benders in shorter segmented lengths (e.g., 6 inches). In order to bend a long (e.g., a 48") length for a high production application, a series of benders has to be abutted end to end and aligned. However, this approach is not always practical or successful because (1) the greater the number of segments, the greater the cost and (2) the more segmented the bender, the greater the chance for misalignment of segments and jamming. If one of the saddles has been bumped or knocked out of position and the rocker becomes trapped and impaired from freely rotating, the result is a failure in the bending operation and a damaged part or tool. Due to the expense and time involved in custom manufacturing such units, and due to the labor involved in alignment and monitoring, these units do not represent a commercially significant market.

Bender manufacturers have attempted to manufacture longer high strength bender devices. For example, Ready Technology has worked with gas nitride to case harden brake die steel. The result is a harder and better wear surface. However, the input of heat and friction tends to cause warped, distorted shaped parts. Particularly for extended length benders, it is critical that the fit and alignment of the parts be dead straight and accurate. That is, for the rocker to rotate within the saddle it needs to be extremely true. This requirement for the rocker and saddle to be absolutely true has dictated the limits on the lengths to which rockers could be manufactured.

The present inventors have extensively experimented with the machining process in an effort to develop a longer length full-hardened rocker. It is well known that, to machine a full-hardened rocker, the V-shaped notch should be machined out while the rocker is still soft before the rocker is hardened, since machining when the rocker is hard is cost prohibitive. However, when the V-shaped notch is machined out of the soft steel rocker before sending the rocker to a through-hardening oven, the result is a bowed piece. Apparently, grinding the rocker introduces stresses and residual stresses which cause the rocker to bow rendering it distorted and unusable.

Accordingly, there remains a need for a long length rotary bender for commercial bending of higher strength or thicker steel. There is likewise a need for a method of manufacturing such a long length rotary bender.

SUMMARY OF THE INVENTION

Recognizing the deficiencies in the present state of the art and the need for a long length heavy duty rotary bender for commercial bending of higher strength and/or thicker steel, the present inventors have investigated all aspects of manufacture.

As a result, the inventors have discovered that a certain combination of materials and process steps can result in the production of the desired durable long length heavy duty rotary bender.

The invention is based in part upon the discovery that a specific grinding technology can be used to grind deep grooves in full hardened steel rockers (e.g., Rc 58–60) up to 42 inches long in any diameter. This makes it possible to grind the V-shaped notch into the rocker after full hardening, rather than before, as conventional. More specifically, once the rocker is full hardened, the V-shaped notch is ground with a creep feed grinding technology which super cools the coolant, which hyperflushes the part as it is being ground, and which moves the part underneath a grinding wheel that is computer controlled and regenerated by a diamond disk dresser very slowly. In accordance with the present invention, by super cooling the coolant and by flushing the grinding process with enormous volumes of coolant, all the stresses and heat are removed before they can input adverse effects of heat and distortion into the part. Further, the grinder wheel is computer controlled and grinds a special computer generated shape that is re-generated after every path by a computer. This keeps the wheel grinding the special profile exactly, even as the grinding wheel wears down.

Further improvements in wear characteristics are seen if the steel, preferably S-7 shock steel, for the rocker is cryogenically tempered as part of the heat treating process. Cryogenic treatment of metals is known, and those treatments which are controlled to result in transformation of unstable austenite particles to smaller, more stable particles of martensite are preferred.

A further aspect of the invention concerns the method of manufacture of the saddle and the saddle produced thereby, which saddle is a necessary component of the long one-piece bender units of the present invention. The same grinding technology as discussed above for the rocker element can be used to grind fully hardened saddles (e.g., Rc 48–52) at long lengths. Since the steel is through hardened, when the big socket round is cut out of it to form the seat for the rocker, the product is a rocker receptacle with steel in a hardened hard state forming the bearing surface of the saddle. Accordingly, it is possible to use fully hardened tool steel in the saddle. On the other hand, for many applications it is sufficient to merely through harden brake die steel for the saddles. This has the advantage that the saddle is made of a metal that is softer and easier to subsequently re-machine and customize. Thus, in accordance with the present invention, instead of the conventional and less expensive brake die steel, extra time and expense is invested in producing a through-hardened steel. That is, the entire piece is hardened to some degree prior to grinding, though the piece may be harder at the outside than at the core, with the core sometimes only a few points softer than the outside surface.

Finally, the present inventors have found that the hardness and slipperiness of the bearing surface of the saddle (socket) can be improved by coating, preferably with a plasma spray "moly" coating that coats molybdenum and molybdenum oxide on the saddle socket (moly-coating). Moly-coating is low cost and well known, but is novel as a coating for bender saddle bearing surfaces. Moly-coating is soft, yet it has surprisingly been found that the molybdenum and molybdenum oxide coating of the saddle bearing surface performs extremely well under high compressive loads, and that the moly-coating accepts oil and is highly porous and thus retains needed lubricant deep in pores of the coating. Moly-coating is preferably performed after grit-blasting of the saddle bearing surface, giving a peak-and-valley contour wherein the molybdenum and molybdenum oxide first fills the low spots and bond, then create a 0.001–0.003 inch thick layer that is excellent in wear and galling resistance. Thus, the through hardened saddle is softer and easier to machine, yet has improved life and is free of the warpage and dimensional inaccuracy associated with saddles which are machined and then hardened, or which are hardened and then machined by conventional techniques.

The above breakthrough thus makes it possible to manufacture long rockers and long saddles out of the best materials possible for the customer commensurate with economy and long life. The rocker is preferably manufactured out of a shock steel, most preferably an S-7 shock steel, which will break much less often than a conventional tool steel.

It is significant that the present invention uses a shock steel rocker and long lengths, and a long length machineable saddle. As discussed above, when using a hard rocker it is preferred to have a comparatively soft saddle. The only place it is desired to have the saddle hardened is at the bearing surface within the socket where the rocker rotates against the saddle. The reason that it is desired to have the saddle machinable (not soft, but machinable) is so that during the manufacturing process modifications and alterations can be performed on the saddle with conventional metal working tools, such that there is no need to grind the saddle the same slow and expensive way as the rocker.

The foregoing has outlined rather broadly the more pertinent and important features of the present invention in order that the detailed description of the invention that follows may be better understood and so that the present contribution to the art can be more fully appreciated.

Additional features of the invention will be described hereinafter which form the subject of the claims of the invention. It should be appreciated by those skilled in the art that the conception and the specific embodiments disclosed may be readily utilized as a basis for modifying or designing other pharmaceutical compositions and methods for treatment for carrying out the same purposes of the present invention. It should also be realized by those skilled in the art that such equivalent formulations and methods do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

Figure 1:
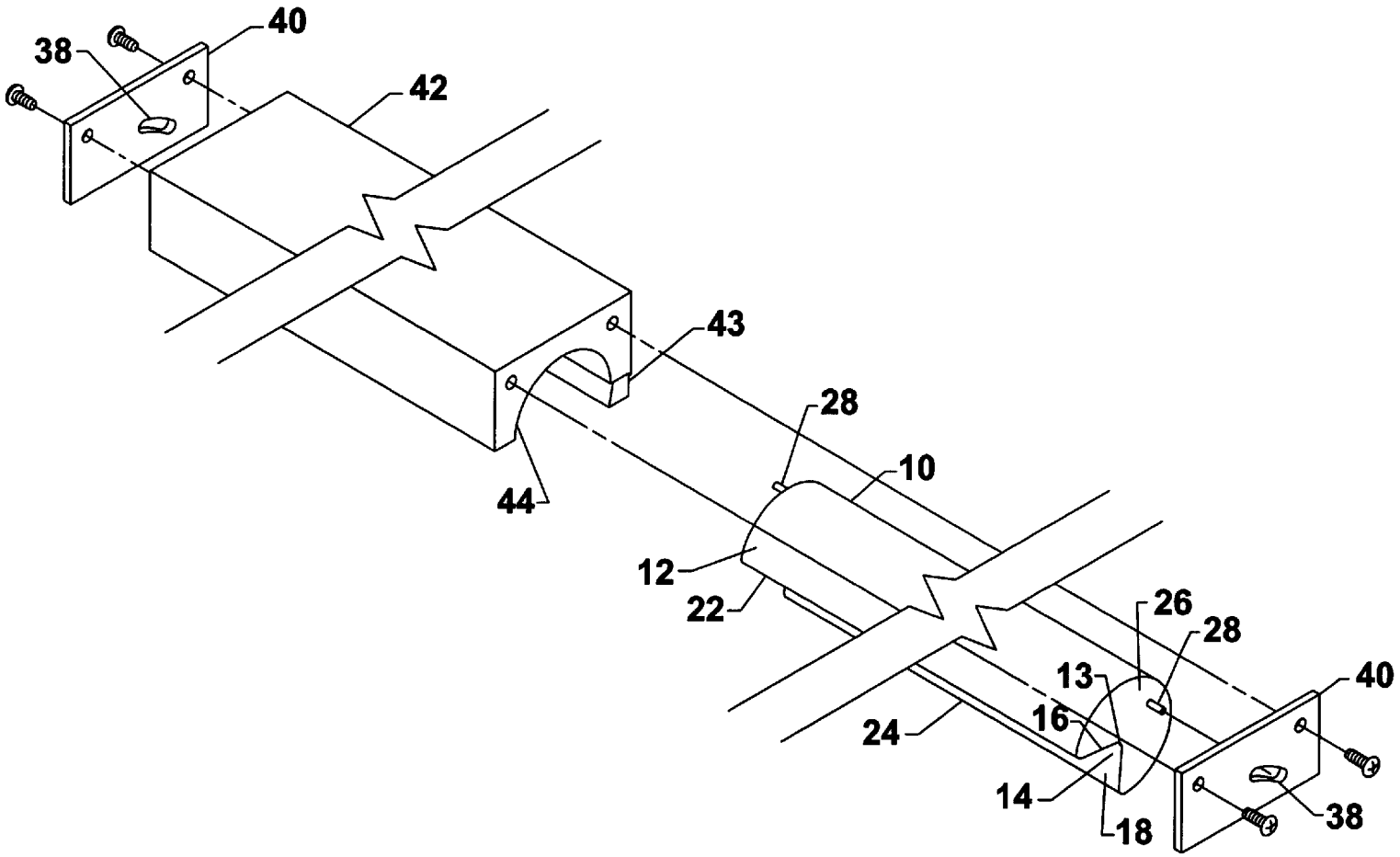
FIG. 1 shows a basic extended length rotary bending tool.

The present invention is not limited to any particular design of rotary bending device, and is applicable to rotary bending devices in general such as disclosed in U.S. Pat. No. 4,434,644; and rotary benders for bending and forming of sheet material in a press or press brake, as disclosed in U.S. Pat. No. 4,535,619, and those references discussed in the Background of the Invention section, the disclosures of each of which are incorporated herein by reference.

The characterizing feature of the present invention is the high-hardness, distortion-free rocker and saddle. The high hardness and the dimensional trueness of the rocker and saddle enable the production of a precisely fitting, long length bender device capable of forming long bends for commercial bending of higher strength and/or thicker steel.

Although the invention is not limited to any design of bender, a brief discussion of bender design follows in order to introduce terminology used in the subsequent section discussing the methods of manufacture.

In the most basic form of the invention, as shown in the embodiment illustrated in FIG. 1, the invention features a bending or forming tool, the operating head 10 of which is an element having a generally cylindrical shape, the peripheral surface 12 of which is intercepted by the formation therein of a longitudinally extending V-shaped notch 14. In the example illustrated the notch 14 is defined by side wall surfaces 16 and 18 forming an angle therebetween which is slightly less than 90°. It should be observed that the innermost or apex surface 13 of the notch 14 falls short of the central or longitudinal axis of the cylinder 10 but is in a line essentially parallel thereto.

The outermost extremities of the side walls 16 and 18 of the notch 14 merge with the cylindrical outer surface 12 of the element 10 by means of radiused wall portions 20. The latter are comprised of generally parallel line formations which, as will be further described, define a fixing edge 22 and a bending edge 24 on the operating head 10.

Projected from and perpendicular to each of the respectively parallel end wall surfaces 26 of the operating head 10 is a pin 28. The pins 28 are in a line parallel to the central longitudinally extending axis of the operating head 10 and in a plane which they commonly occupy together with the line defining the apex 13 of the notch 14. It should be noted that whereas the apex 13 of the notch 14 is relatively closely adjacent to the central axis of the operating head 10, the line occupied by the pins 28 is relatively remote therefrom, the pins positioning in adjacent and closely spaced relation to the outer surface 12 of the element 10.

In operation, as shown in FIGS. 1–5 of U.S. Pat. No. 4,002,049, as a press closes, the radially outermost edges of the notch 14 provide circumferentially spaced lines of contact with longitudinally spaced portions of the strip or sheet material from which a part is to be formed. One line of contact of the operating head or roller is referenced to a portion of the sheet material which is backed by the related forming die while the other thereof engages the unsupported portion of the sheet material to be bent. On closing of the press, the roller moves in a rotating path to bend the unsupported portion of the sheet material out of its normal plane to assume and set in whatever angular position is dictated by the complementary forming die means. A proper set is insured since the nature of the tool permits the simultaneous application of both vertical and lateral forces to the engaged portion of the work material.

In the preferred embodiment of the bending tool just described, the angle formed by the side walls of the notch will be determined by the angle to be assumed by the bent portion of the work material. Means are included to control the rotation of the bending tool to insure the limits of its rotation will be such to not only minimize the introduction of stress in the sheet material on which it operates but to achieve a precise control of the set. In the embodiment of FIG. 1, the pins 28 project through and bear in arcuate slots 38 formed in plates 40 releasably fixed in connection with opposite outer sides of a device 42 forming a holder for the operating head 10. A gib 43, as described in greater detail in U.S. Pat. No. 5,404,742, is preferably also provided.

Again, the present invention is not limited to the rotary bending tool of FIG. 1 or any particular bender design, and encompasses rotary benders for bending and forming of sheet material in a press or press brake, as disclosed in U.S. Pat. No. 4,535,619. This patent teaches a rotary bending apparatus and provides a die assembly featuring a punch embodying a separable part so constructed and arranged as to render it capable of providing the punch with any one of a plurality of operating surface portions which differ in configuration by changing its relative orientation and disposition. It also features, in cooperation with and in opposed relation to the punch, an assembly providing a rotary bending tool comprising a notched rotor contained for rotation in and with respect to a saddle, which is contained, in turn, by and for movement relative to a base member in a construction and arrangement wherein the relative position of the saddle and the rotor may be precisely and quickly gauged by a segment of the sheet material to be worked between the punch and the rotor of the opposed rotary bending tool. A preferred mount of the punch and the opposed rotor as the tooling provided in a press brake has the assembly of each thereof backed by a plate the form and nature of which is such to produce a horizontal stiffening of the ram or bed to which it applies. In using the apparatus in a press brake the sheet material to be worked is introduced between the opposed tools at an acute angle to a horizontal.

Any lubricant and lubrication means as conventional in the art may be used in the rotary bending tool of the present invention.

The rocker element and the saddle may have a return mechanism, such as a simply arranged spring, which automatically moves the rocker element to its starting or inoperative position.

Rotary benders according to the present invention are designed to bend up to one million parts, to bend mild or hard steel, and to bend parts having thicknesses ranging from 0.010 inches to 0.25 inches.

The rockers according to the present invention are at least 12 inches long, and are preferably from 24 to 48 inches in length. Since the benders according to the invention allow the formation of up to 48 inch bends using a one piece unit, the bender is not liable to the misalignment or jamming problems associated with the previous segmented rotary benders.

Next, the methods of manufacture of the rocker and saddle of the present invention will be discussed.

Rocker Hardening

The rocker is preferably manufactured from a shock steel, preferably an S-7 shock steel, and most preferably Crucible S7, a chrome/molybdenum tool steel characterized by high shock resistance and toughness, together with high hardness and good machining and heat treatment properties. Shock steel will break much less often than a conventional tool steel. However, the present invention is not limited to any particular steel. Other steel, such as A-6, A-2, CPM10-V, M-2, and D-2 have been tested and found to work, though S-7 is preferred.

In a departure from the conventional manufacturing process, the present inventors fully harden the rocker (preferably to Rc 58–60) prior to grinding the V-shaped notch. The present invention thus differs from the conventional techniques which machine the part prior to hardening, as described for example in U.S. Pat. No. 4,415,378 entitled "Case hardening method for steel parts". This patent describes case hardening surfaces of steel parts to insure the presence of a relatively high percentage of untempered martensite within a case hardened depth of at least ten thousandths of an inch and a Rockwell C surface hardness in the range of 59 to 68, and requires the completion of all conventional metal removal operations on the part including finish machining steps prior to heat treatment thereof. Full hardening is well known and need not be described herein.

Rocker Grinding

The present invention makes use of a grinding technology which can handle full hardened steel rockers up to 36 inches long in any diameter up to 3" outer diameter to grind the V-shaped notch into the rocker after case hardening. More specifically, once the rocker is fully hardened, the V-shaped notch is ground using a grinder such as a Blohm CNC grinding machine, model Planomat 412, 21 H.P., Type 3121235 CNC, with a grinding area (L×W) of 48×16 inches, and a grinding spindle speed of from 45 to 3,400 RPM, available from United Grinding Technologies, Inc. of Miamisburg, Ohio, also called a "creep feed" grinding machine (see, e.g., the creep speed grinding operation disclosed in U.S. Pat. No. 4,590,573 entitled "Computer-controlled grinding machine"), with a grinding technology which:

(a) uses a chiller which super cools the water or oil based coolant to prevent the temperature from rising as the coolant absorbs heat, and to maintain the coolant at approximately room temperature;

(b) hyperflushes the grinding area with coolant as the part as it is being ground, with the coolant nozzle at the side of the wheel head, preferably at a flow rate of about 60 gallons per minute and a pressure of 60 PSI, from a tank containing about 400 gallons of coolant, the coolant cleaning the grinding area as it cools; and (c) moves the part underneath a diamond disk dressed grinding wheel very slowly, preferably at a rate of from 2 to 15 inches per minute, more preferably from 4 to 12 inches per minute.

Creep feeder type grinders are well known, as disclosed in Mark Albert, "Taking the Creep Out of Creep-Feed Grinding", pp. 80–87, in November 1982 issue of Modern Machine Shop; Thesis by Stuart C. Salmon entitled Creep-Feed Surface Grinding, dated September 1979 and now available at the Univ. of Bristol in England, (87 pages, FIGS. 1–32, Plates 1–14, and Appendices 1–7); and in U.S. Pat. No. 5,611,724 "Grinding wheel having dead end grooves and method for grinding therewith"; U.S. Pat. No. 4,555,873 "Method and apparatus for wheel conditioning in a grinding machine"; U.S. Pat. No. 4,553,355 "Grinding control methods and apparatus"; U.S. Pat. No. 4,535,572 "Grinding control methods and apparatus"; and U.S. Pat. No. 4,535,571 "Grinding control methods and apparatus". Thus, those working in this art are familiar with the types and operation of these grinders.

By super cooling the coolant and by irrigating or flushing with enormous volumes of coolant, all the stresses and heat are removed before they can input adverse effects of heat and distortion into the part. The coolant is preferably a water based coolant as described in U.S. Pat. No. 5,611,724.

The grinder wheel is computer controlled (CNC) and grinds a special computer generated shape that is re-generated after every path by a computer. When using the Blohm Planomat grinder as discussed above, software such as BLOHM-Profile maybe run on a separate windows-based PC, and controlling a table mounted diamond roll dressing attachment PEA-TL 150 driven by a water-proofed A.C. motor toothed-belt. This dressing keeps the wheel grinding the special profile exactly, even if the wheel breaks or wears down. Such grinding techniques and apparatus are disclosed in, e.g., U.S. Pat. No. 4,553,355 entitled "Grinding control methods and apparatus". The grinding control methods and apparatus pertain generally to maintaining the shape and sharpness of a grinding wheel, despite the tendency of the wheel face to deteriorate from the desired shape and sharpness, as grinding of a given workpiece or a succession of workpieces proceeds. Generally, as a common denominator, a "conditioning element" is brought into rubbing contact with the face of the grinding element under specially controlled and unique conditions to (i) restore the desired shape (conventionally called truing), or (ii) to establish the desired degree of sharpness (conventionally called "dressing") or to accomplish both (i) and (ii) simultaneously. The controlled rubbing contact can be caused either while the grinding wheel is free of grinding contact with a workpiece or simultaneously while grinding is occurring, and then either continuously or intermittently. The methods and apparatus in many of their various embodiments involve use of a "truing element" or a "conditioning element" which may be a generally homogeneous metal, and in many cases the same metal as that of the workpieces being ground. This advantageously results in lower costs as well as greater productivity and workpiece quality (both size tolerance and surface finish).

This grinding technology makes it possible to manufacture long rockers and long saddles out of the best materials possible for the customer commensurate with economy and long life.

Heat treating

A further aspect of the invention involves improvement of the wear characteristics of the S-7 shock steel for the rocker by a heat treating process which involves heat tempering and then cryogenically tempering the steel. After a conventional heat tempering the rocker is cryogenically treated by gradually lowering to a temperature of between −300 and −330° F., preferably between −310 to −320° F., using cryogenic media such as liquefied or solidified gasses, for a period of time ranging from about ten minutes to about 36 hours. At these very cold temperatures the minute, unstable particles of austenite are changed into even smaller, more stable particles of martensite, and additional fine particles are formed to still further increase the wear resistance of the rocker. This treatment is not just a surface treatment—it takes place all through the rocker and is practically irreversible. The martensite does not revert to austenite even at temperatures considerably above normal operating conditions.

While it is possible to treat the rocker with dry ice at temperatures of between −100 and −120° F. to obtain high hardness, it has been found that wear resistance is further improved when temperatures are reduced to between −300 and −330° F. as discussed above.

Techniques for cryogenic treatment are well known and are disclosed in U.S. Pat. No. 4,175,987 entitled "Low alloy tempered martensitic steel". Reference may also be made to U.S. Pat. No. 5,221,372 entitled "Fracture-tough, high hardness stainless steel and method of making same" disclosing a cryogenically-formed and tempered stainless steel having improved fracture toughness and corrosion resistance at a given hardness level, such as, for example, of at least about Rc 60 for bearing applications. The steel includes a cryogenically-formed martensitic microstructure tempered to include about 5 to about 10 volume % post-deformation retained austenite dispersed therein and M2 C-type carbides, where M is Cr, Mo, V, and/or Fe, dispersed in the microstructure.

Further, reference may be made to U.S. Pat. No. 5,259,200 entitled "Process for the cryogenic treatment of metal containing materials" wherein shockability, wearability, stability and hardness of the metal are improved by cryogenic treatment.

Detailed discussions of suitable tempering procedures can also be found in U.S. Pat. No. 3,891,477 entitled "Material treatment by cryogenic cooling". Steel is cryogenic cooled for altering the microstructure of the materials for improved resistance to wear, to corrosion, and the like, including the steps of reducing the material to a predetermined low temperature at a preselected uniform rate below a rate which will cause thermal fracturing within the grain boundaries, holding the materials at such low temperature for a substantial period of time depending upon the material characteristics and other features, and thereafter permitting the temperature of the material to return to normal. The procedure is carried out by supporting the material above a body of cryogenic fluid, e.g., liquid nitrogen at −320° F., and incrementally bringing the material and the fluid together by either lowering the material into the fluid or by raising the body of fluid to envelop the material for the stepwise temperature reduction of the material, emerging the material in the fluid to produce the desired low temperature, holding the material in the cryogenic fluid for the predetermined substantial length of time at which the temperature of the material is to be maintained at such low temperature (preferably about 18 hours to about 30 hours, and lifting the material from the fluid or permitting the fluid to boil off and thereafter allowing the material to return to room temperature.

Specific examples of the overall rocker manufacture procedures following heat treatment and relative to rocker size will now be provided. The following examples are merely illustrative of the manufacturing process and are not limiting.

Ground stock (S-7) is available in 12' bar lengths centerless ground (outside diameter ground) to specs, (±0.001 to specified diameter).

Rockers of ⅝" and 1" diameter: These rockers are cut to length (e.g., 12" and 24"), then sent to a machining center to mill plunger slots, which are milled in one set up. The CNC milling machine is programmed to make a straight move in to dimension the V-shaped notch and then an angled moved to complete the V-shaped notch shaped slot. These rocker parts are not center-drilled. They are sent to the heat treat step where they are cryogenically tempered and straightened to 0.002/0.003 TIR. After heat treating they are centerless ground to size.

The rockers are then ground as follows:

| | |
|---|---|
| ⅝" Rockers. Ground from Solid. Entire Form Ground. 4 passes | |
| 1st pass | .164 DP at 4 IPM (inch/minute) |
| 2nd pass | .100 DP at 4 IPM |
| 3rd pass | .018 DP at 7 IPM |
| 4th pass | .0028 DP at 12 IPM |
| 1" Rockers. Ground from Solid. Entire Form Ground. 5 passes | |
| 1st pass | .204 DP at 6 IPM |
| 2nd pass | .140 DP at 4 IPM |
| 3rd pass | .08 DP at 7 IPM |
| 4th pass | .0048 DP at 8 IPM |
| 5th pass | .001 DP at 12 IPM |

Rockers 1½" to 3": Steel is cut into lengths of 66" then run on a horizontal mill to cut a V-shaped notch to a 87° included angle using specially designed M-42 cobalt cutters made for horizontal milling machine. These cutters are readily available through many suppliers. The milling leaves approximately 0.010 stock. Bars machined and treated in this manner can be used for almost all rockers. After the V-shaped notch is cut, pieces are cut to length and center-drilled. Parts are then moved to the machining center, plunger slots are milled, and the parts are sent to be heat treated as discussed above.

After heat treatment the outer diameter of the parts are ground to size.

Once rockers are ground to correct diameter, they are sent to creep feed where they are ground as follows:

| | |
|---|---|
| 1½" Rockers. Pre-Machined — 2 passes | |
| 1st pass | .060 DP at 8 IPM |
| 2nd pass | .001 DP at 12 IPM |
| 2" Rockers. Pre-Machined — 2 passes | |
| 1st pass | .098 DP at 8 IPM |
| 2nd pass | .002 DP at 12 IPM |
| 2½" Rockers. Pre-Machined — 2 passes | |
| 1st pass | .125 DP at 5 IPM |
| 2nd pass | .002 DP at 12 IPM |
| 3" Rockers. Pre-Machined — 2 passes | |
| 1st pass | .150 DP at 4 IPM |
| 2nd pass | .002 DP at 12 IPM |

During grinding these parts may be held in special fixtures, such as ones which have the same basic design as a saddle only ground flat on the bottom with a 7° angle on the front. The resultant vise acts similar to a V-block and the part is clamped in same position each time (i.e., each pass).

The rockers are ground with an 87° included angle, and checked for correct dimensions.

Saddle

A further aspect of the invention concerns the method of manufacture of the long one-piece saddle and the saddle produced thereby, which saddle is a necessary component of the long one-piece bender units of the present invention.

With a conventional brake die steel the outside of the part is hardened (case hardened) to a certain hardness and the hardness mellows towards the core. When cutting a semi-circular rocker socket from the core of such a conventional brake die steel, especially in the case of larger diameter units, the inventors have found that the wear surface for the rocker is really too soft and too easily galled.

In accordance with the present invention, instead of the conventional and less expensive brake die steel, the inventors go through the extra time and expense of producing a through-hardened steel which is very similar to brake die except that it is hardened all the way through. Since the steel is hardened all the way through, when the big socket round is cut out of it, the product is a rocker receptacle with steel in the hardened state forming the bearing surface of the saddle. Accordingly, it is a feature of the present invention to use a through hardened brake die steel in manufacturing the saddle. As discussed elsewhere herein, for most applications a through hardened steel (with a moly-coated bearing surface) is preferred over a full hardened saddle.

Basically, the larger diameter saddle manufacturing process differs from the smaller diameter saddle manufacturing process in the amount of material which must be removed; thus the smaller diameter process may begin with the slow and precise creep feed grinding, while the large diameter process may begin with a more conventional and more rapid milling process to remove some material prior to engaging the slow and precise creep feed grinding of the saddle bearing surface.

Bar steel suitable for saddles is available from Crucible Steel ground to size and in either 37" lengths or drop pieces at 34" length. These bars can be ordered ground to tolerances (square and parallel to ±0.001/0.002).

A 37" length bar can be machined on a vertical machining center. 36" long saddles are machined as one piece. 12" and 24" long pieces are machined on the same bar and then cut to length.

After grinding, it is preferred not to roughen the socket of the ⅝" and 1" saddles on the machining center. 1½", 2", 2½" and 3" are preferably socket roughed in a machining center with a 1" carbide inserted ball and nose end mill. Any programmer familiar with this technology can write a computer program to run this operation, and refinements and improvements can be made over time for particular applications. It is also possible to use a horizontal milling machine with convex cutters manufactured for the above-listed specific sizes. The cutters used in the examples are commercially available.

The finished (gib screw holes and plungers) bars are then moved to the CNC creep feed grinder. The bigger bars (2", 2½", 3") are cut (if necessary) to the 12" and 24" lengths (for ease of handling); ⅝", 1, and 1½" are ground in the bar length and then cut. See U.S. Pat. No. 4,553,355 entitled "Grinding control methods and apparatus" teaching CNC methods to restore the desired shape (truing) or to establish the desired degree of sharpness ("dressing")

⅝", 1", and 1½" bars are ground complete with socket and gib seat. The contour is dressed on the grinding wheel. 2", 2½", and 3" bars are ground with just the socket complete. The gib seat is then finish milled in a machining center, in the same set up as the rough milled socket. Bars are checked after grinding for correct dimensions.

It is significant that the present invention uses a shock steel rocker and long lengths, and preferably a machineable saddle. As discussed above, when using a hard rocker it is preferred to have a comparatively soft saddle. The only place it is desired to have the saddle hardened is at the bearing surface within the socket where the rocker rotates against the saddle. The reason that it is desired to have the saddle machinable (not soft, but machinable) is so that during the manufacturing process modifications and alterations can be performed on the saddle with conventional metal working tools, such that there is no need to grind the saddle the same slow and expensive way as the rocker.

Once the rocker and saddle have been manufactured, assembly is the same as all benders. Gibs are preferably fitted as necessary by grinding either the bottom to tighten the fit or at the angle (rocker contacting face) to loosen the fit. It has been found that the gibs need less adjustment due to the consistency of the gib seat in relationship to the socket. No wiper felt is used in the two smaller sizes. Wiper felt, if used, is used only on the GIB side of socket on 1½, 2, 2½, 3" sizes. This allows use of these size saddles for CB7 (narrow channel) applications.

Preferably, an oiler system is provided through the plungers. Instead of the conventional system (holes drilled through the socket in two directions and tapped (1 hole) with a ⅛-27 pipe tape), this new oiler system has check valves made with the same threads as set screws. This allows elimination of 3 operations. These check valves double as set screws for the plunger mechanism as well as provide an easy way to lubricate units. These check valves may be manufactured in standard English threads (¼-20, ⅜-16, 7⁄16-20, ⅝-16) as well as metric threads (M6×1, M10×1.5, M12×1.75, M16×2). These have slots machined in part to accept a flat blade screwdriver. No special tools are needed for assembly. This design was used for ease of manufacturing (less machine time and set up), as well as ease of use for customer. If a check valve malfunctions or is misplaced, the rotary bender can be used with the simple replacement of a standard set screw, a regular screw, a threaded rod, etc. Most industrial facilities have a supply of screws readily available. These check valves are available from Gits Manufacturing, Creston, Iowa.

In accordance with the present invention it becomes possible to produce HIB and HMB benders in long lengths, and then to segment these into segments to fill orders. Segmenting can be done with an abrasive cut off saw equipped with a digital read out, which cuts parts to length with a good finish. Very little finish work is needed with such a saw—it will cut both hardened and soft steel equally well.

Moly-Coating

Yet another feature of the preferred embodiment of the invention resides in the selection of a specific coating and coating technique which is economical yet offers a number of advantages. The coating can be applied to the bearing surface of the rocker, the saddle, or both rocker and saddle, but is preferredly applied to the saddle.

Basically, it is known that a conventional chromium plating exhibits good wear resistance, but is susceptible to scuffing. A molybdenum-sprayed coating has an oil retaining property and shows excellent scuff resistance, but exhibits inferior wear resistance as compared to chromium plating.

In accordance with the present invention a plasma spray "moly" coating is preferably employed that coats both molybdenum and molybdenum oxide, thereby improving the hardness and slipperiness of the bearing surface of the saddle (socket). Moly-coating is low cost and well known, but is novel as a coating for bender saddle bearing surfaces. Moly-coating is soft, yet it has surprisingly been found that the molybdenum and molybdenum oxide coating of the saddle bearing surface performs extremely well under high compressive loads (much better than many of the very hard coatings; the greater the compressive load put on the part, the more slippery it gets), and that the moly-coating accepts oil and is highly porous and thus retains needed lubricant deep in pores of the coating (superior to other coatings), thus this coating makes the socket both hard and slippery. Moly-coating is preferably performed after grit-blasting of the saddle bearing surface, giving a peak-and-valley contour wherein the molybdenum and molybdenum oxide first fill the low spots and bond, then create a 0.001–0.003 inch thick layer that is excellent in wear and galling resistance. Thus, the through hardened saddle is softer and easier to machine, yet has improved life and is free of the warpage and dimensional inaccuracy associated with saddles which are machined and then hardened, or which are hardened and then machined by conventional techniques.

Moly-coating also does not subject the piece part to sustained high temperatures to coat and so does not distort the part. The coating is a porous type coating which soaks up oil and retains it in a superior way to other coatings.

Alternatives to the above include chromium and molybdenum coatings wherein content of the components are optimized for balanced properties. U.S. Pat. No. 4,233,072 teaches a sliding member having the wear- and scuff-resistant coating obtained by plasma-arc spraying a mixture comprising 60 to 85% of molybdenum powder, 10 to 30% of nickel-chromium alloy powder and 5 to 20% of titanium carbide powder on the surface of the sliding member made of iron or steel. When molybdenum powder content is less than 60% in the mixture, the scuff resistant property of the coating deteriorates, and when molybdenum powder content is more than 85% in the mixture, portion having relatively low hardness such as micro Vickers hardness ranging from 500 to 600 increases, because molybdenum is hardly oxidized by plasma-arc spraying, and as a result the wear resistance of the coating deteriorates suddenly. Therefore, the preferable content of molybdenum powder in this mixture is 65 to 85%.

Somewhat different from molybdenum-chrome coating is nickel-chromium alloy powder, used for higher strength of the coatings. When nickel powder and chromium powder are added individually, increase in the strength of the coating is not obtainable. Further, as the result of increasing oxidation of chromium, the wear resistance of the coating deteriorates largely. Accordingly, pre-alloyed nickel-chromium alloy powder should be used, preferably with the ratio of nickel to chromium in the nickel-chromium alloy of about 4:1, to achieve maximum strength of the coating and improved wear resistance. When the quantity of the nickel-chromium alloy powder in the mixture is less than 10%, the increase in coating strength is comparatively small, and the strength of the coating increases with the increase of mixing quantity of the nickel-chromium alloy powder. When the nickel-chromium alloy phase in the coating becomes too much, the wear resistance and the scuff resistance decrease. Therefore, the preferable quantity of nickel-chromium alloy powder in this mixture is about 10 to 30%.

Titanium carbide may be added to improve the wear resistance of the coating. When the quantity of titanium carbide in the mixture is less than 5%, the effect is small. The wear resistance of the coating increases according to the increase of mixing quantity of titanium carbide. But when that quantity is over 20%, the mating sliding surface wears excessively. Therefore, the preferable quantity of titanium carbide in the mixture is about 5 to 20%.

Further, U.S. Pat. No. 5,332,422 (Rao) teaches a solid lubricant coating system for use with a metal interface subject to high temperatures and wet lubrication. The solid lubricant coating system comprises agglomerates of particles forming grains and adhered to a metal surface. The particles may be molybdenum disulfide and steel particles fused together and bounding the molybdenum disulfide particles at least at certain intersections, certain portions of the steel particles being air-hardened to a high hardness upon exposure of the coating to the interface at high temperatures. The air-hardened hardness of the steel is about Rc 60. The coefficient of friction achieved by the coating system is about 0.14 dry and 0.06–0.08 under partially wet lubricated conditions. Molybdenum disulfide is also an oil attracter.

Yet another wear resistant coating and coating technology which may be used in the present invention is the electroless coating disclosed in U.S. Pat. Nos. 4,833,041 and 5,019,163, the disclosures of which are incorporated herein by reference. These patents teach corrosion and wear resistant metallic compositions containing nickel, cobalt, boron and thallium and articles coated therewith. Preferred electroless coatings contain nickel and cobalt in a ratio of about 45:1 to about 4:1 and are deposited as hard, amorphous alloy nodules of high nickel content dispersed or rooted in a softer alloy of high cobalt content. The coatings are preferably deposited on catalytically active substrates from an electroless coating bath containing nickel ions, cobalt ions, thallium ions, metal ion complexing agents and a borohydride reducing agent at pH about 12 to about 14. With post-coating heat treatment coated surfaces exhibit hardness levels as high as about 1300 Knoop. The coatings are not porous but are oil retentive, and are particularly useful for deposition on a surface of an article of manufacture which is subject to sliding or rubbing contact with another surface under unusual wearing and bearing pressures.

The above discussion of coatings is not intended to be limiting, and further examples of suitable coatings can be found in U.S. Pat. Nos. 4,621,026; 5,213,907; 5,431,804 and 5,314,608.

However, in the present environment of use, considering the best balance of properties, of the above listed coatings a coating of molybdenum and molybdenum oxide is preferred.

With respect to the above description then, it is to be realized that the optimum formulations and methods of the invention are deemed readily apparent and obvious to one skilled in the art, and all equivalent relationships to those described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described.

What is claimed is:

1. A bending and forming device comprising:

a rocker, wherein said rocker has a generally cylindrical body including a longitudinally extending groove in its outer peripheral surface;

a holder for said rocker, said holder including means defining a saddle for seating said rocker, said saddle comprising a saddle block having a base, a longitudinally extended substantially hemi-cylindrical recess in a surface thereof remote from its base and affording a load accommodating seat for said rocker, said rocker mounting for rotation on and relative to said holder and presenting the groove therein to the materials to be worked in its bending and forming function; and means defining a retention device mounted on said saddle, in releasable connection therewith and to one side of said groove therein, constructed and arranged to have only a limited surface portion thereof overlie and bear on a portion of said operating head to hold said head to and for a balanced rocking or rotative movement on said seat;

wherein said rocker is produced by a process comprising:

(a1) fully hardening a steel rocker blank to a Rockwell C hardness of from 56 to 62 by a process comprising heat tempering and cryogenic tempering to cause conversion of austenite particles to a martensite microstructure;

(b1) grinding a longitudinally extending groove along the outer peripheral surface of the hardened rocker blank with a CNC creep feed grinder with measures to prevent stress and heat distortion in said rocker, said measures including super cooling a coolant and hyperflushing the rocker with said coolant as said rocker blank is being ground; and wherein said saddle is formed by a process comprising:

(a2) hardening a saddle block to a Rockwell C hardness of from 28 to 58;

(b2) grinding a longitudinally extending, substantially hemispherical recess in said saddle block dimensioned to receive said rocker, said grinding comprising grinding with a CNC creep feed grinder with measures to prevent stress and heat distortion of said saddle, said measures including super cooling a coolant and hyperflushing said saddle with said coolant as it is being ground.

2. A bending and forming device as in claim 1, wherein said saddle is formed by through hardening, and wherein said recess is coated with a wear resistant coating including at least one of molybdenum, nickel, chromium and titanium.

3. A bending and forming device as in claim 2, wherein said coating is formed by plasma spraying molybdenum and molybdenum oxide.

4. A bending and forming device as in claim 3, wherein said coating formed by plasma spraying molybdenum and molybdenum oxide is coated to a thickness of from 0.001 to 0.003 inches.

5. A bending and forming device as in claim 1, wherein said recess is surface roughened prior to coating with molybdenum and molybdenum oxide.

6. A bending and forming device as in claim 2, wherein said coating is applied by a technique selected from plasma spray coating and electroless coating.

7. A bending and forming device as in claim 1, wherein said hemispherical recess in said saddle has a Rockwell C hardness of from 28–35.

8. A bending and forming device as in claim 1, wherein said hemispherical recess in said saddle has a Rockwell C hardness of from 28–30.

9. A bending and forming device as in claim 1, wherein said bending and forming device is at least 9.5 inches in length.

10. A bending and forming device as in claim 1, wherein said bending and forming device is at least 24 inches in length.

11. A bending and forming device as in claim 1, wherein said cryogenic treatment is at a temperature of at least −100° F.

12. A bending and forming device as in claim 1, wherein said cryogenic treatment is at a temperature of at least −300° F.

13. A bending and forming device as in claim 1, wherein said cryogenic treatment is at a temperature of at least −310° F.

14. A bending and forming device as in claim 1, wherein said rocker is formed of S-7 shock steel.

15. A bending and forming device as in claim 1, wherein said rocker has a Rockwell C hardness of from 56–60.

16. A bending and forming device as in claim 1, wherein said rocker is ⅝ inches in diameter and said bending and forming device is at least 6.5 inches in length.

17. A bending and forming device as in claim 1, wherein said rocker is inch in diameter and said bending and forming device is at least 9.5 inches in length.

18. A bending and forming device as in claim 1, wherein said rocker is 1.5 inches in diameter and said bending and forming device is at least 8.5 inches in length.

19. A bending and forming device as in claim 1, wherein said rocker is 2 inches in diameter and said bending and forming device is at least 8.5 inches in length.

20. A bending and forming device as in claim 1, wherein said rocker is 2.5 inches in diameter and said bending and forming device is at least 8.5 inches in length.

21. A bending and forming device as in claim 1, wherein said rocker is 3 inches in diameter and said bending and forming device is at least 8.5 inches in length.

* * * * *